US009402127B2

(12) United States Patent
Wei et al.

(10) Patent No.: US 9,402,127 B2
(45) Date of Patent: Jul. 26, 2016

(54) EARPHONE

(71) Applicants: Tsinghua University, Beijing (CN); HON HAI PRECISION INDUSTRY CO., LTD., New Taipei (TW)

(72) Inventors: Yang Wei, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 270 days.

(21) Appl. No.: 13/932,980

(22) Filed: Jul. 1, 2013

(65) Prior Publication Data

US 2014/0140529 A1 May 22, 2014

(30) Foreign Application Priority Data

Nov. 20, 2012 (CN) ..... 2012 1 04710640

(51) Int. Cl.
*H04R 1/10* (2006.01)
*H04R 25/00* (2006.01)
*H04R 23/00* (2006.01)

(52) U.S. Cl.
CPC ..... *H04R 1/1091* (2013.01); *H04R 23/002* (2013.01)

(58) Field of Classification Search
CPC .. H04R 23/004; H04R 23/006; H04R 19/005; H04R 19/02; H04R 19/04; H04R 2201/003; H04R 1/1066; H04R 1/1075; H04R 1/1091; H04R 2307/023; H04R 23/002
USPC ..... 381/164, 74
See application file for complete search history.

(56) References Cited

U.S. PATENT DOCUMENTS

| | | | |
|---|---|---|---|
| 7,876,912 | B2 | 1/2011 | Liu et al. |
| 8,059,841 | B2 | 11/2011 | Jiang et al. |
| 8,208,661 | B2 | 6/2012 | Jiang et al. |
| 8,300,855 | B2 | 10/2012 | Liu et al. |
| 8,494,187 | B2 | 7/2013 | Jiang et al. |
| 8,553,912 | B2 | 10/2013 | Wang et al. |
| 2005/0201575 | A1 | 9/2005 | Koshida et al. |
| 2006/0043576 | A1 | 3/2006 | Lee |
| 2006/0233388 | A1 | 10/2006 | Liow et al. |
| 2008/0170727 | A1 | 7/2008 | Bachman et al. |
| 2010/0067714 | A1 | 3/2010 | Cheng |

(Continued)

FOREIGN PATENT DOCUMENTS

| | | |
|---|---|---|
| CN | 101771920 | 7/2010 |
| CN | 102307715 | 1/2012 |

(Continued)

*Primary Examiner* — Davetta W Goins
*Assistant Examiner* — Daniel Sellers
(74) *Attorney, Agent, or Firm* — ScienBiziP, P.C.

(57) ABSTRACT

An earphone includes a shell and a thermoacoustic chip. The shell defines a first space. The thermoacoustic chip is disposed in the space of the shell. The thermoacoustic chip includes a speaker and a capsule defining a second space to accommodate the speaker. The speaker includes a substrate, a sound wave generator, a first electrode and a second electrode. The first electrode and the second electrode are spaced from each other and electrically connected to the sound wave generator. The substrate includes a first surface and a second surface opposite to the first surface. The capsule has at least one through hole and at least two connectors. The sound wave generator is opposite to the at least one through hole. Two of the at least two connectors are electrically connected with the first electrode and the second electrode.

18 Claims, 15 Drawing Sheets

(56) References Cited

U.S. PATENT DOCUMENTS

| | | | | |
|---|---|---|---|---|
| 2010/0086166 | A1* | 4/2010 | Jiang et al. | 381/380 |
| 2010/0166232 | A1* | 7/2010 | Liu et al. | 381/164 |
| 2010/0195858 | A1* | 8/2010 | Rasmussen et al. | 381/320 |
| 2010/0203929 | A1 | 8/2010 | Skagmo et al. | |
| 2010/0260357 | A1 | 10/2010 | Liu et al. | |
| 2010/0311002 | A1* | 12/2010 | Jiang et al. | 432/227 |
| 2011/0033069 | A1 | 2/2011 | Liu et al. | |
| 2011/0051961 | A1 | 3/2011 | Jiang et al. | |
| 2011/0054659 | A1 | 3/2011 | Carlson et al. | |
| 2012/0250905 | A1 | 10/2012 | Jiang et al. | |
| 2012/0250907 | A1 | 10/2012 | Jiang et al. | |
| 2012/0250908 | A1 | 10/2012 | Jiang et al. | |
| 2013/0129119 | A1 | 5/2013 | Miyatake et al. | |
| 2013/0216074 | A1 | 8/2013 | Kon | |

FOREIGN PATENT DOCUMENTS

| | | |
|---|---|---|
| JP | 11-300274 | 11/1999 |
| JP | 2005-57479 | 3/2005 |
| JP | 2005-057495 | 3/2005 |
| JP | 3808493 | 5/2006 |
| JP | 2008-167252 | 7/2008 |
| JP | 2009-141880 | 6/2009 |
| JP | 2010-74831 | 4/2010 |
| JP | 2010-93804 | 4/2010 |
| JP | 2010-288270 | 12/2010 |
| JP | 2011-41269 | 2/2011 |
| JP | 2012-039272 | 2/2012 |
| JP | 2012-39272 | 2/2012 |
| JP | 2012-94942 | 5/2012 |
| JP | 2012-209923 | 10/2012 |
| TW | 209093 | 7/1993 |
| TW | I246735 | 1/2006 |
| TW | M299999 | 10/2006 |
| TW | 200644701 | 12/2006 |
| TW | I273715 | 2/2007 |
| TW | 200725861 | 7/2007 |
| TW | 200743677 | 12/2007 |
| TW | 201002097 | 1/2010 |
| TW | 201018256 | 5/2010 |
| TW | 201029481 | 8/2010 |
| TW | 201043763 | 12/2010 |
| TW | 201118938 | 6/2011 |
| TW | 201125373 | 7/2011 |
| TW | 201143474 | 12/2011 |
| TW | I356396 | 1/2012 |
| TW | 201240480 | 10/2012 |
| TW | 201240486 | 10/2012 |

* cited by examiner

EARPHONE

RELATED APPLICATIONS

This application claims all benefits accruing under 35 U.S.C. §119 from China Patent Application No. 201210471064.0, filed on Nov. 20, 2012 in the China Intellectual Property Office, the contents of which are hereby incorporated by reference. This application is related to commonly-assigned applications entitled, "THERMOACOUSTIC CHIP", filed Jun. 28, 2013 Ser. No. 13/930,490, the contents of the above commonly-assigned applications are hereby incorporated by reference.

BACKGROUND

1. Technical Field

The present disclosure relates to earphones and, particularly, to a carbon nanotube based earphone.

2. Description of Related Art

Conventional earphone generally includes earphone housing and a sound wave generator disposed in the earphone housing. The earphones can be categorized by shape into ear-cup (or on-ear) type earphones, earphones, ear-hanging earphones, for example. The earphones can be disposed in the ears of a user. The ear-cup type earphones and ear-hanging earphones are disposed outside and attached to the ears of a user. The ear-cup type earphones have circular or ellipsoid ear-pads that completely surround the ears. The ear-hanging type earphones have ear-pads that sit on top of the ears, rather than around them. The earphones can also be categorized as wired earphones and wireless earphones.

The earphone housing generally is a plastic or resin shell structure defining a hollow space therein. The sound wave generator inside the earphone housing is used to transform an electrical signal into sound pressure that can be heard by human ears. There are different types of sound wave generators that can be categorized according by their working principle, such as electro-dynamic sound wave generators, electromagnetic sound wave generators, electrostatic sound wave generators and piezoelectric sound wave generators. However, all the various types ultimately use mechanical vibration to produce sound waves and rely on "electro-mechanical-acoustic" conversion. Among the various types, the electro-dynamic sound wave generators are most widely used. However, the structure of the electric-powered sound wave generator is dependent on magnetic fields and often weighty magnets.

Carbon nanotubes (CNT) are a novel carbonaceous material having extremely small size and extremely large specific surface area. Carbon nanotubes have received a great deal of interest since the early 1990s, and have interesting and potentially useful electrical and mechanical properties, and have been widely used in a plurality of fields. The carbon nanotube film used in the speaker has a large specific surface area, and extremely small heat capacity per unit area that make the sound wave generator emit sound audible to humans. However, the carbon nanotube film used in the speaker has a small thickness and a large area, and is likely to be damaged by the external forces applied thereon.

What is needed, therefore, is to provide an earphone for solving the problem discussed above.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
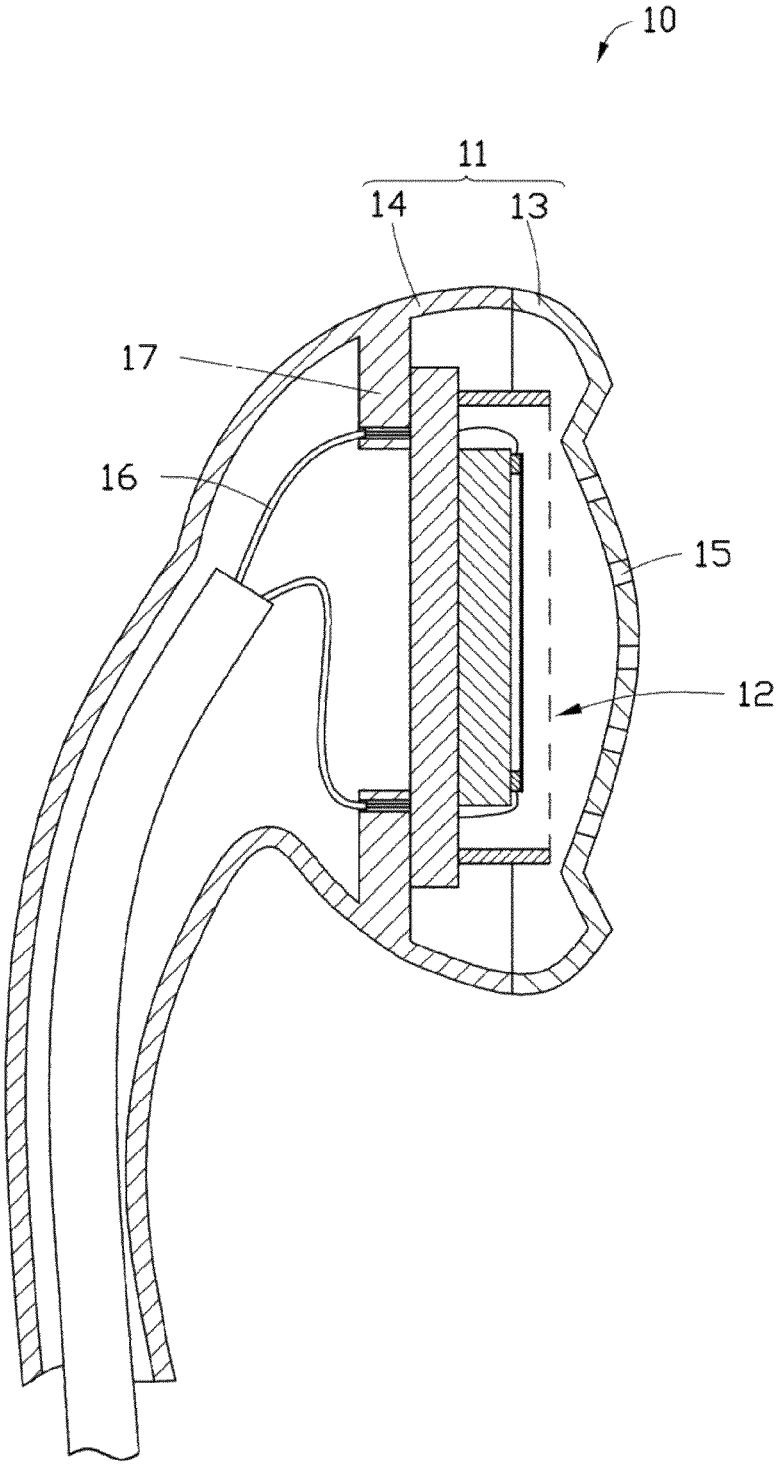
FIG. 1 is a schematic view of one embodiment of an earphone.

Referring to FIG. 1, one embodiment of an earphone 10 is shown. The earphone 10 includes a shell 11 and a thermoacoustic chip 12 disposed in the shell 11. The shell 11 defines a first space. The thermoacoustic chip 12 is received in the first space of the shell 11.

The shell 11 includes a front shell 13 and a back shell 14. The front shell 13 and the back shell 14 are combined to form the hollow structure by a snap-fit. The thermoacoustic chip 12 can be attached on the back shell 14 by a fastener. When the thermoacoustic chip 12 fails to work, it is convenient to replace the thermoacoustic chip 12. A plurality of through openings 15 is defined in the front shell 13. The thermoacoustic chip 12 is spaced from and opposite to the plurality of through openings 15. The plurality of through openings 15 allows sound wave to transmit out of the shell 11.

The shell 11 can be made of lightweight and strong plastic or resin. The shell 11 covers an ear of user so as to be used friendly. Furthermore, the earphone 10 includes a plurality of leading wires 16 electrically connected to the thermoacoustic chip 12. The plurality of leading wires 16 is used to input audio electrical signals and driving electrical signals into the thermoacoustic chip 12. The earphone 10 can further include a plurality of heat-sink holes (not shown) located in the back shell 14.

The thermoacoustic chip 12 includes a speaker 100 and a capsule 200. The capsule 200 defines a second space to accommodate and protect the speaker 100.

Figure 2:
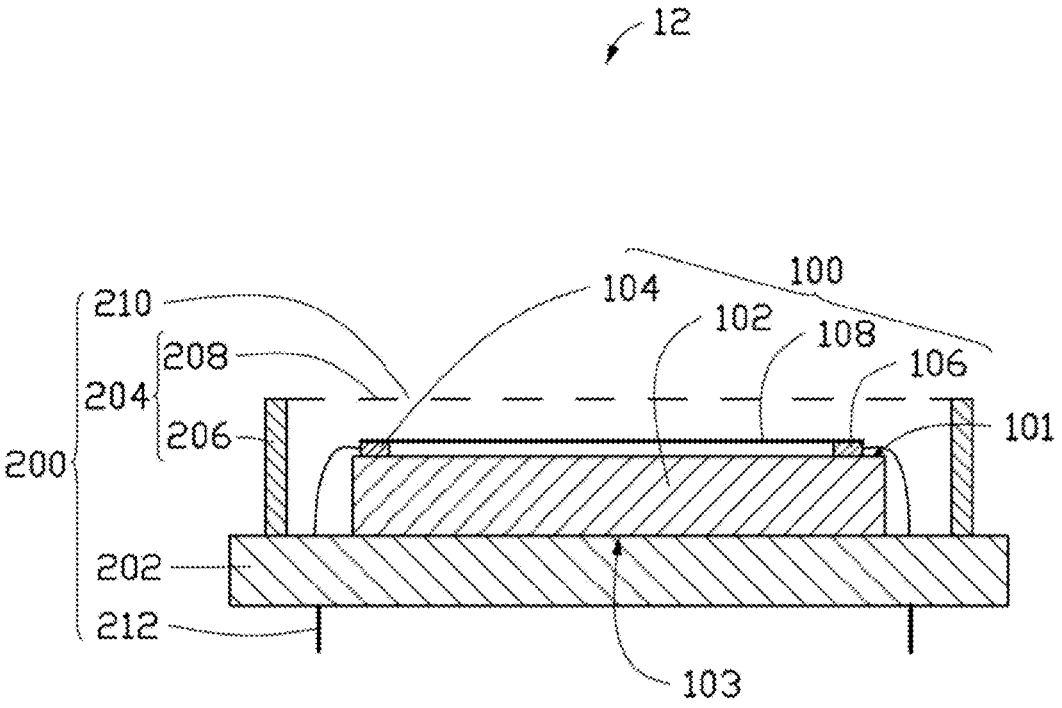
FIG. 2 is a schematic view of a thermoacoustic chip of the earphone of FIG. 1.

Referring to FIG. 2, the speaker 100 includes a substrate 102, a first electrode 104, a second electrode 106, and a sound wave generator 108. The first electrode 104 and the second electrode 106 are spaced from each other and electrically connected to the sound wave generator 108. The substrate 102 includes a first surface 101 and a second surface 103 opposite to the first surface 101. When the substrate 102 is insulative, the first electrode 104 and the second electrode 106 can be located on the first surface 101 of the substrate 102 directly. The sound wave generator 108 can be in contact with the first surface 101 of the substrate 102 or spaced from the first surface 101 of the substrate 102 by the first electrode 104 and the second electrode 106. That is, part of the sound wave generator 108 is suspended by the first electrode 104 and the second electrode 106 and free of contact with any other surface.

The shape of the substrate 102 is not limited, such as round, square, or rectangle. The first surface 101 and the second surface 103 of the substrate 102 can be flat or curved. The size of the substrate 102 can be selected according to need. The thickness of the substrate 102 can be in a range from about 0.2 millimeters to about 0.8 millimeters. Thus, the speaker 100 can meet the demand for miniaturization of the electronic devices, such as mobile phones, computers, headsets or walkman. The material of the substrate 102 is not limited and can be made of flexible materials or rigid materials. In one embodiment, the resistance of the substrate 102 is greater than the resistance of the sound wave generator 108. When the sound wave generator 108 is in contact with the first surface of the substrate 102, the substrate 102 should be made of material with a certain heat-insulating property, so that the heat produced by the sound wave generator 108 will not be absorbed by the substrate 102 too fast and too much and the sound wave generator 108 can produce sound. The material of the substrate 102 can be glass, ceramic, quartz, diamond, polymer, silicon oxide, metal oxide, or wood. In one embodiment, the substrate 102 is a square glass plate with the thickness of about 0.6 millimeters and the side length of about 0.8 millimeters. The first surface is flat.

The sound wave generator 108 has a very small heat capacity per unit area. The heat capacity per unit area of the sound wave generator 108 is less than $2\times10^{-4}$ J/cm$^2$*K. The sound wave generator 108 can be a conductive structure with a small heat capacity per unit area and a small thickness. The sound wave generator 108 can have a large specific surface area for causing the pressure oscillation in the surrounding medium by the temperature waves generated by the sound wave generator 108. The term "surrounding medium" means the medium outside of the sound wave generator 108, and does not include the medium inside of the sound wave generator 108. When the sound wave generator 108 includes carbon nanotubes, the "surrounding medium" does not include the medium inside of each carbon nanotube. The sound wave generator 108 can be a free-standing structure. The term "free-standing" includes, but is not limited to, a structure that does not have to be supported by a substrate and can sustain the weight of it when it is hoisted by a portion thereof without any significant damage to its structural integrity. The suspended part of the sound wave generator 108 will have more sufficient contact with the surrounding medium (e.g., air) to have heat exchange with the surrounding medium from both sides of the sound wave generator 108. The sound wave generator 108 is a thermoacoustic film.

The sound wave generator 108 can be or include a free-standing carbon nanotube structure. The carbon nanotube structure may have a film structure. The thickness of the carbon nanotube structure may range from about 0.5 nanometers to about 1 millimeter. The carbon nanotubes in the carbon nanotube structure are combined by van der Waals attractive force therebetween. The carbon nanotube structure has a large specific surface area (e.g., above 30 m$^2$/g). The larger the specific surface area of the carbon nanotube structure, the smaller the heat capacity per unit area will be. The smaller the heat capacity per unit area, the higher the sound pressure level of the sound produced by the sound wave generator 108.

The carbon nanotube structure can include at least one carbon nanotube film, a plurality of carbon nanotube wires, or a combination of carbon nanotube film and the plurality of carbon nanotube wires.

The carbon nanotube film can be a drawn carbon nanotube film formed by drawing a film from a carbon nanotube array that is capable of having a film drawn therefrom. The heat capacity per unit area of the drawn carbon nanotube film can be less than or equal to about $1.7\times10^{-6}$ J/cm$^2$*K. The drawn carbon nanotube film can have a large specific surface area (e.g., above 100 m$^2$/g). In one embodiment, the drawn carbon nanotube film has a specific surface area in the range of about 200 m$^2$/g to about 2600 m$^2$/g. In one embodiment, the drawn carbon nanotube film is a pure carbon nanotube structure consisting of a plurality of carbon nanotubes, and has a specific weight of about 0.05 g/m$^2$.

The thickness of the drawn carbon nanotube film can be in a range from about 0.5 nanometers to about 100 nanometers. When the thickness of the drawn carbon nanotube film is small enough (e.g., smaller than 10 μm), the drawn carbon nanotube film is substantially transparent.

Figure 3:
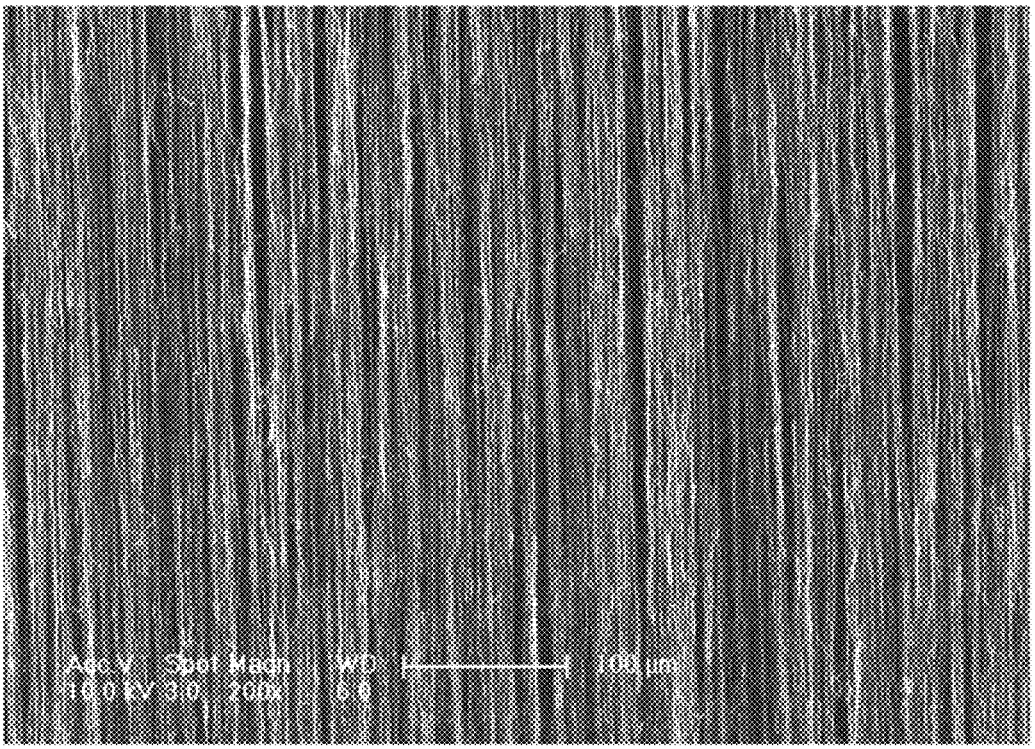
FIG. 3 shows a Scanning Electron Microscope (SEM) image of the drawn carbon nanotube film.
Figure 5:
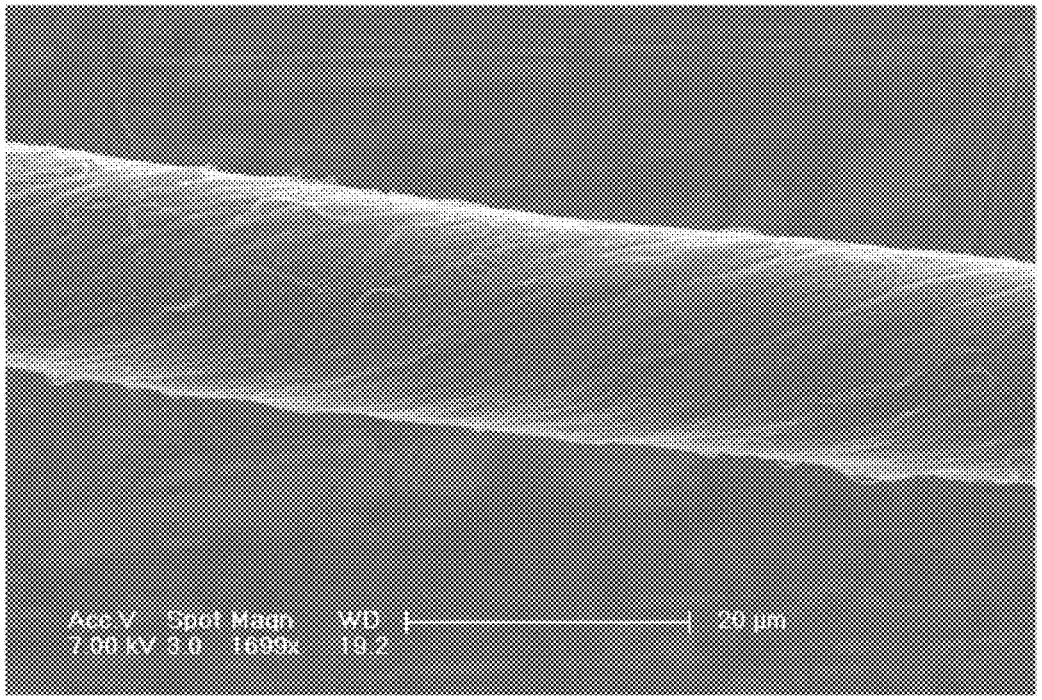
FIG. 5 shows an SEM image of a twisted carbon nanotube wire.

Referring to FIG. 3, the drawn carbon nanotube film includes a plurality of successive and oriented carbon nanotubes joined end-to-end by van der Waals attractive force therebetween. The carbon nanotubes in the drawn carbon nanotube film can be substantially oriented along a single direction and substantially parallel to the surface of the carbon nanotube film. Furthermore, an angle β can exist between the oriented direction of the carbon nanotubes, in the drawn carbon nanotube film, and a direction from the first electrode 104 to the second electrode 106. The angle is in the range of $0\leq\beta\leq90°$. In one embodiment, the oriented direction of the plurality of carbon nanotubes substantially extends along a direction perpendicular with the extending direction of the first electrode 104 and the second electrode 106. As can be seen in FIG. 5, some variations can occur in the drawn carbon nanotube film. The drawn carbon nanotube film is a free-standing film. The drawn carbon nanotube film can be formed by drawing a film from a carbon nanotube array that is capable of having a carbon nanotube film drawn therefrom. Furthermore, the plurality of carbon nanotubes is substantially parallel with the first surface 101.

The carbon nanotube structure can include more than one carbon nanotube films. The carbon nanotube films in the carbon nanotube structure can be coplanar and/or stacked. Coplanar carbon nanotube films can also be stacked one upon other coplanar films. Additionally, an angle can exist between the orientation of carbon nanotubes in adjacent films, stacked and/or coplanar. Adjacent carbon nanotube films can be combined by only the van der Waals attractive force therebetween without the need of an additional adhesive. The number of the layers of the carbon nanotube films is not limited. However, as the stacked number of the carbon nanotube films increases, the specific surface area of the carbon nanotube structure will decrease. A large enough specific surface area (e.g., above 30 $m^2/g$) must be maintained to achieve an acceptable acoustic volume. An angle θ between the aligned directions of the carbon nanotubes in the two adjacent drawn carbon nanotube films can range from about 0 degrees to about 90 degrees. Spaces are defined between two adjacent carbon nanotubes in the drawn carbon nanotube film. When the angle θ between the aligned directions of the carbon nanotubes in adjacent drawn carbon nanotube films is larger than 0 degrees, a microporous structure is defined by the carbon nanotubes in the sound wave generator 108. The carbon nanotube structure in an embodiment employing these films will have a plurality of micropores. Stacking the carbon nanotube films will add to the structural integrity of the carbon nanotube structure.

The plurality of carbon nanotube wires is parallel with and spaced from each other. The plurality of carbon nanotube wires substantially extends along a direction perpendicular with the extending direction of the first electrode 104 and the second electrode 106. Each of the plurality of carbon nanotube wires includes a plurality of carbon nanotubes, and the extending direction of the plurality of carbon nanotubes is parallel with the carbon nanotube wire. The plurality of carbon nanotube wires is suspended by the first electrode 104 and the second electrode 106 and spaced from the first surface 101 of the substrate 102.

A distance between adjacent two carbon nanotube wires ranges from about 1 micrometer to about 200 micrometers, such as 50 micrometers, 150 micrometers. In one embodiment, the distance between adjacent tow carbon nanotube wires is about 120 micrometers. A diameter of the carbon nanotube wire ranges from about 0.5 nanometers to about 100 micrometers. In one embodiment, the distance between adjacent two carbon nanotube wires is about 120 micrometers, and the diameter of the carbon nanotube wire is about 1 micrometer.

Figure 4:
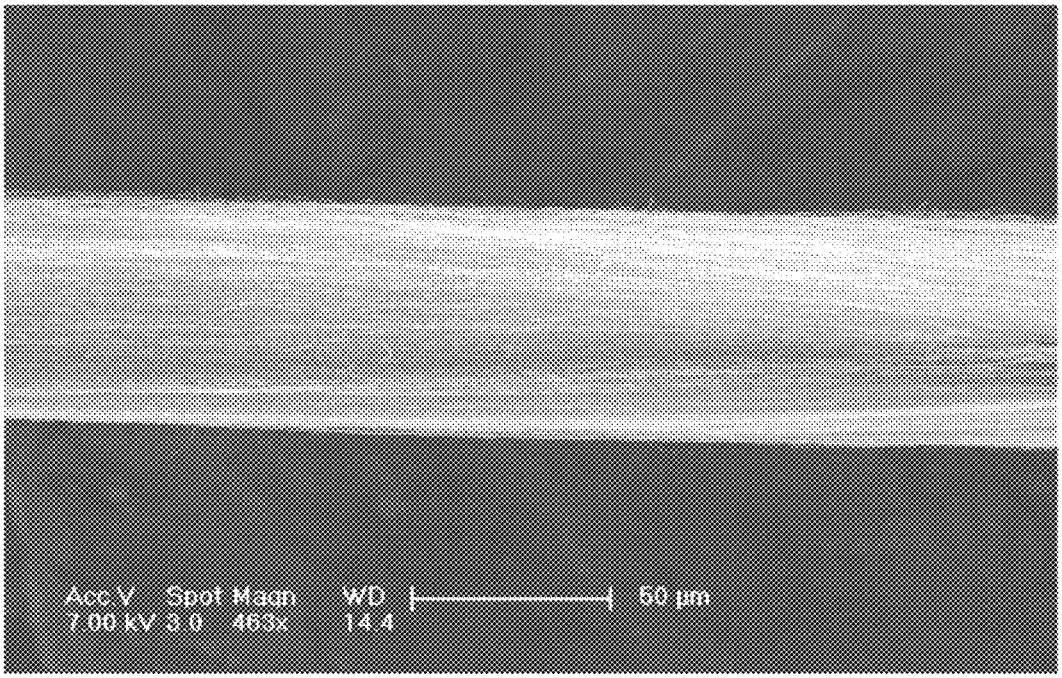
FIG. 4 shows an SEM image of an untwisted carbon nanotube wire.

The carbon nanotube wire can be untwisted or twisted. Treating the drawn carbon nanotube film with a volatile organic solvent can form the untwisted carbon nanotube wire. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into untwisted carbon nanotube wire. Referring to FIG. 4, the untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. More specifically, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity and shape. Length of the untwisted carbon nanotube wire can be arbitrarily set as desired. A diameter of the untwisted carbon nanotube wire ranges from about 0.5 nm to about 100 μm.

The twisted carbon nanotube wire can be formed by twisting a drawn carbon nanotube film using a mechanical force to turn the two ends of the drawn carbon nanotube film in opposite directions. Referring to FIG. 5, the twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end to end by van der Waals attractive force therebetween. Each carbon nanotube segment includes a plurality of carbon nanotubes parallel to each other, and combined by van der Waals attractive force therebetween. Length of the carbon nanotube wire can be set as desired. A diameter of the twisted carbon nanotube wire can be from about 0.5 nm to about 100 μm. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease, while the density and strength of the twisted carbon nanotube wire will be increased. The deformation of the sound wave generator 108 can be avoided during working, and the distortion degree of the sound wave can be reduced.

In one embodiment, the sound wave generator 108 is a single drawn carbon nanotube film drawn from the carbon nanotube array and suspended by the first electrode 104 and the second electrode 106. The drawn carbon nanotube film can be attached on the first electrode 104 and the second electrode 106 by the adhesive property of itself or by a conductive bonder. The carbon nanotubes of the drawn carbon nanotube film substantially extend from the first electrode 104 to the second electrode 106. The drawn carbon nanotube film has a thickness of about 50 nanometers, and has a transmittance of visible lights in a range from about 67% to about 95%.

The first electrode 104 and the second electrode 106 are electrically connected to the sound wave generator 108 and used to input audio signal to the sound wave generator 108. The audio signal is input into the carbon nanotube structure through the first electrode 104 and the second electrode 106. The first electrode 104 and the second electrode 106 can be located on the first surface 101 of the substrate 102 or on two supports (not shown) on the substrate 102. The first electrode 104 and the second electrode 106 are made of conductive material. The shape of the first electrode 104 or the second electrode 106 is not limited and can be lamellar, rod, wire, and block among other shapes. A material of the first electrode 104 or the second electrode 106 can be metals, conductive adhesives, carbon nanotubes, and indium tin oxides among other conductive materials. The first electrode 104 and the second electrode 106 can be metal wire or conductive material layers, such as metal layers formed by a sputtering method, or conductive paste layers formed by a method of screen-printing. In one embodiment, the first electrode 104 and the second electrode 106 are two parallel conductive paste layers.

The capsule 200 is used to protect the speaker 100 so that the carbon nanotube structure would not be damaged because the strength of the carbon nanotube film is relatively low. The shape and size of the capsule 200 is not limited. The capsule 200 defines at lease one through hole 210 allowing the sounds produced by the speaker 100 to transmit outside of the capsule 200. In one embodiment, the capsule 200 includes a planar plate 202 and a housing 204 located on a surface of the plate 202. The speaker 100 is located on the plate 202 and in the housing 204. The sound wave generator 108 is located between the substrate 102 and the through hole 210, and the sound wave generator 108 has a surface opposite to the through hole 210.

The plate 202 can be a glass plate, a ceramic plate, a printed circuit board (PCB), a polymer plate, or a wood plate. The plate 202 is used to support and fix the speaker 100. The shape and size of the plate 202 is not limited. The size of the plate 202 is greater than the size of the speaker 100. The area of the plate 202 can be in a range from about 36 square millimeters to about 150 square millimeters, such as 49 square millimeters, 64 square millimeters, 81 square millimeters, or 100 square millimeters. The thickness of the plate 202 can be in a range from about 0.5 millimeters to about 5 millimeters, such as 1 millimeter, 2 millimeters, 3 millimeters, or 4 millimeters. The housing 204 has a side wall 206 and a bottom wall 208 connected to the side wall 206. The side wall 206 is curved to form a hollow structure with a cross section in shape of round, square, or rectangle. The bottom wall 208 defines a plurality of through holes 210. The shape and size of the housing 204 can be selected according to need. The size of the housing 204 is a little greater than the size of the speaker 100. The housing 204 can be fixed on the plate 202 by an adhesive, or installed on the plate 202 by a fastener. The material of the housing 204 can be glass, ceramic, polymer, or metal. In one embodiment, the plate 202 is a PCB, the housing 204 is a metal bucket with a plurality of through holes 210 on the bottom wall 208. The housing 204 is spaced from the speaker 100.

The capsule 200 can further includes two connectors 212 on the side wall 206 or plate 202. The two connectors 212 can be located on the same side or different side of the capsule 200. One of the two connectors 212 is electrically connected with the first electrode 104 and the other one is electrically connected with the second electrode 106. When the two connectors 212 are pins, the pins can be inserted into the holes of the PCB of the electronic device using the thermoacoustic chip 12 so that the speaker 100 is electrically connected with an external circuit. When the two connectors 212 are pads, the pads can be welded with the pads of the PCB of the electronic device using the thermoacoustic chip 12 so that the speaker 100 is electrically connected with an external circuit. In one embodiment, the two connectors 212 are pins and located on the bottom surface of the plate 202 and electrically connected with the first electrode 104 and the second electrode 106 via wires.

The thermoacoustic chip 12 is accommodated in the shell 11. The capsule 200 can be fixed on the back shell 14 of the shell 11 by a binder, card slot, or pinning structure. In one embodiment, the capsule 200 is fixed onto the back shell 14 by a bulge structure. The bulge structure and the back shell 14 integrity form. Part of the capsule 200 is attached with the bulge structure. Part of the capsule 200 is suspended to make heat generated by the sound wave generator 108 of the speaker 100 dissipate sufficiently.

The material of the bulge structure can be insulative material, such as diamond, glass, ceramic, quartz, plastic or resin. The bulge structure can have a good thermal insulating property, thereby preventing the bulge structure from absorbing the heat generated by the sound wave generator 108.

Figure 6:
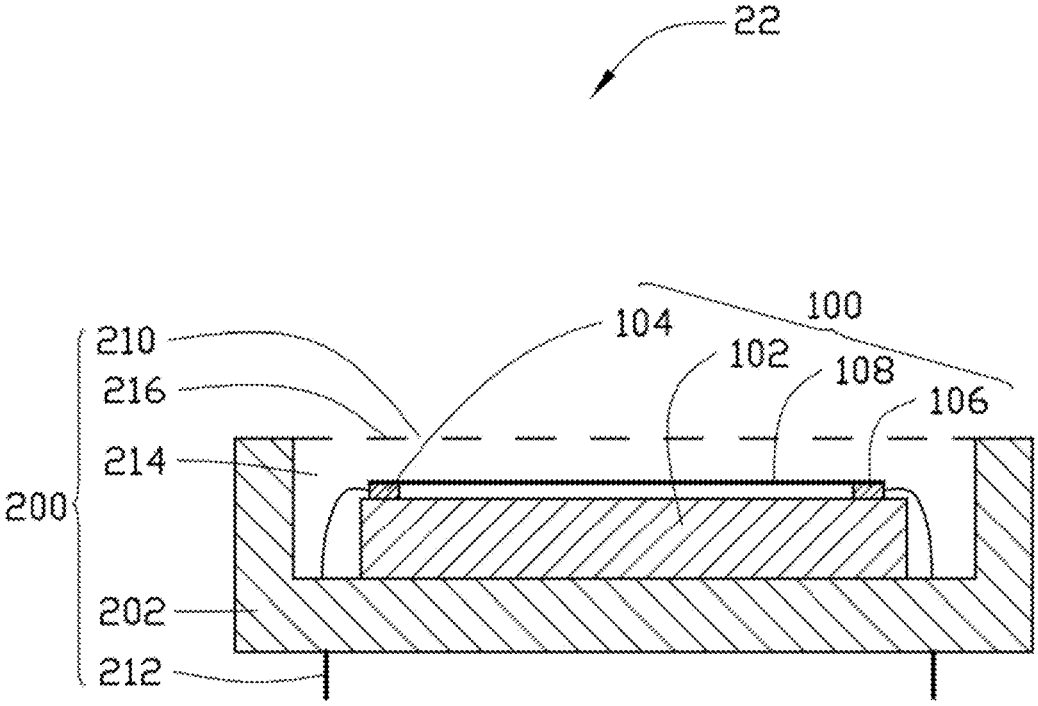
FIG. 6 is a schematic view of a thermoacoustic chip of an earphone in a second embodiment.

Referring to FIG. 6, a thermoacoustic chip 22 of an earphone of a second embodiment is shown. The structure of the thermoacoustic chip 22 is similar to that of the thermoacoustic chip 12 except that the capsule 200 includes the plate 202 defining a first recess 214 and a cover 216 covering the first recess 214, and the speaker 100 is located in the first recess 214. The cover 216 has a plurality of through holes 210. The cover 216 can be a metal mesh, fiber net, or a metal plate with a plurality of through holes, a glass plate with a plurality of through holes, a polymer plate with a plurality of through holes, or a ceramic plate with a plurality of through holes. The first recess 214 can be formed by punching, etching, or stamping. In one embodiment, the plate 202 is a PCB, and the cover 216 is a metal mesh and extends to be suspended above the first recess 214. Two connectors 212 can be located on the side surface or bottom surface of the plate 202.

Figure 7:
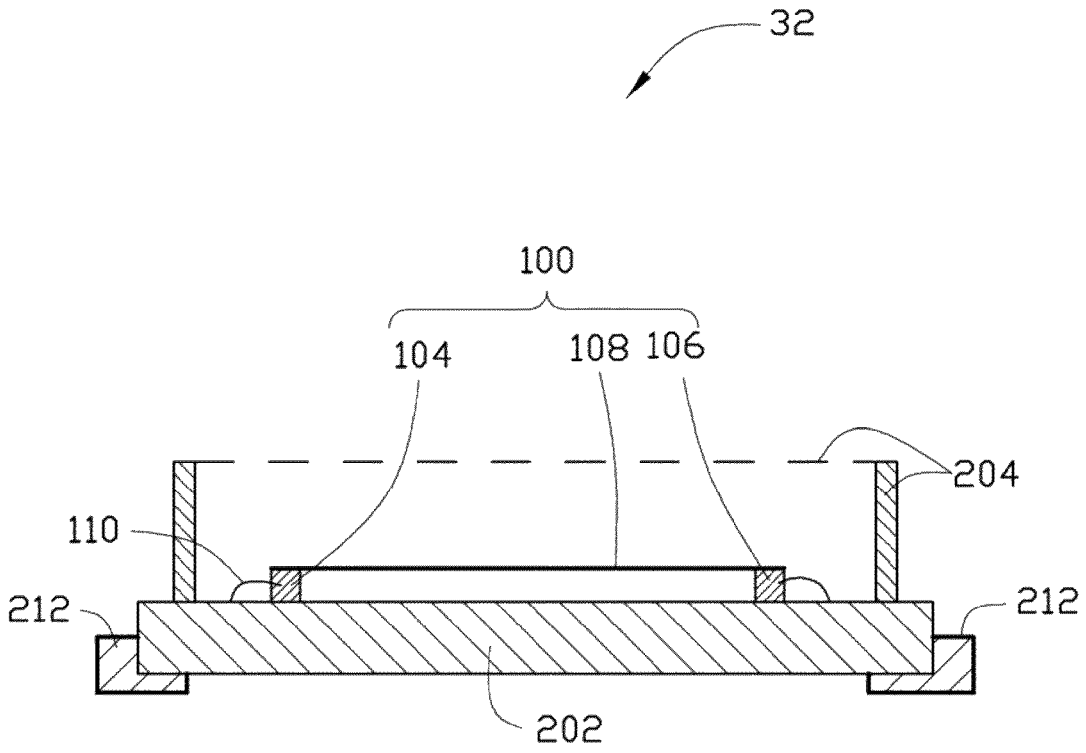
FIG. 7 is a schematic view of a thermoacoustic chip of an earphone in a third embodiment.

Referring to FIG. 7, a thermoacoustic chip 32 of an earphone of a third embodiment is shown. The structure of the thermoacoustic chip 32 is similar to that of the thermoacoustic chip 12, except that the speaker 100 only includes a first electrode 104, a second electrode 106, and a sound wave generator 108, and the two connectors 212 are located on two different sides of the capsule 200. In one embodiment, the first electrode 104 and the second electrode 106 are located on the surface of the plate 202 directly, and the sound wave generator 108 are suspended over the first electrode 104 and the second electrode 106. That is, the speaker 100 omits the substrate 102 and has a simple structure. The plate 202 is insulated. When the plate 202 is electrical conductive, an insulative layer need to coated on the plate 202.

Figure 8:
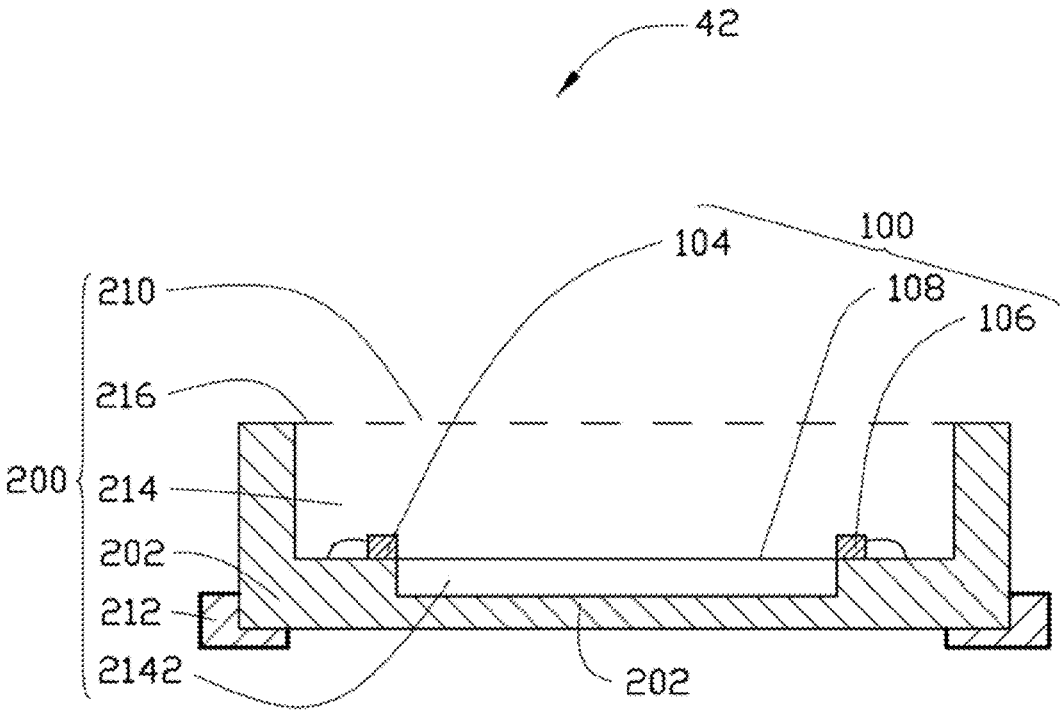
FIG. 8 is a schematic view of a thermoacoustic chip of an earphone in a fourth embodiment.

Referring to FIG. 8, a thermoacoustic chip 42 of an earphone of a fourth embodiment is shown. The structure of the thermoacoustic chip 42 is similar to that of the thermoacoustic chip 22, except that the speaker 100 only includes a first electrode 104, a second electrode 106, and a sound wave generator 108, and the two connectors 212 of the capsule 200 are located on two different corners of the plate 202. In one embodiment, a depression 2142 is formed on the bottom surface of the first recess 214, and the sound wave generator 108 is suspended over the depression 2142. The first electrode 104 and the second electrode 106 are located on the surface of the sound wave generator 108. That is, two ends of the sound wave generator 108 are sandwiched between the electrode 104, 106 and the bottom surface of the first recess 214.

Figure 9:
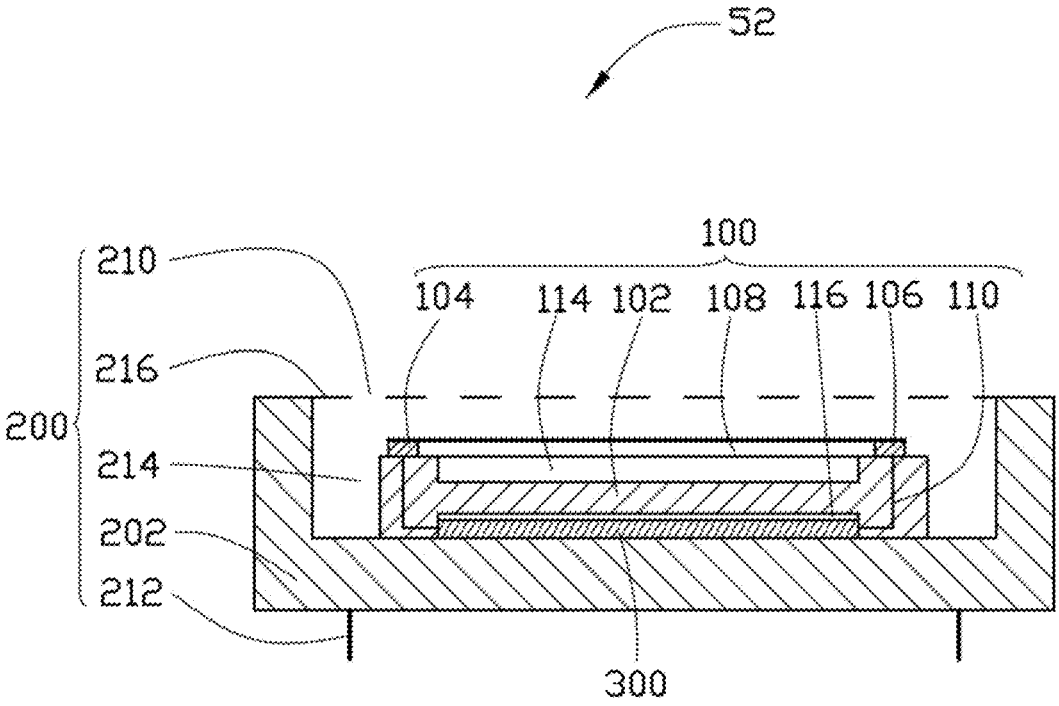
FIG. 9 is a schematic view of a thermoacoustic chip of an earphone in a fifth embodiment.

Referring to FIG. 9, a thermoacoustic chip 52 of an earphone of a fifth embodiment is shown. The thermoacoustic chip 52 includes a speaker 100, a capsule 200 and an integrated circuit (IC) chip 300. The capsule 200 defines a space to accommodate and protect the speaker 100 and the IC chip 300.

The structure of the thermoacoustic chip 52 is similar to that of the thermoacoustic chip 22, except that further includes the IC chip 300 located in the capsule 200 and electrically connected with the speaker 100. In one embodiment, the substrate 102 defines a second recess 114 on the first surface 101 and a cavity 116 on the second surface 103. The sound wave generator 108 is suspended over the second recess 114, and the IC chip 300 is located in the cavity 116. The capsule 200 can further include four connectors 212. Two of the four connectors 212 are only electrically connected with the IC chip 300 and used to supply driving voltage, and the other two of the four connectors 212 are electrically connected with the first electrode 104 and the second electrode 106 via the IC chip 300 and used to input audio signal.

The IC chip 300 can be located on any surface of the substrate 102 or embedded inside of the substrate 102. The IC chip 300 can be fixed on the substrate 102 by an adhesive, or attached on the substrate 102 by a fastener. The IC chip 300 includes a power amplification circuit for amplifying audio signal and a direct current (DC) bias circuit. Thus, the IC chip 300 can amplify the audio signal and input the amplified audio signal to the sound wave generator 108, simultaneously, the IC chip 300 can bias the DC electric signal. The shape and size of the IC chip 300 can be selected according to need. The internal structure of the IC chip 300 is simple because the IC chip 300 only plays the function of power amplification and DC bias. The area of the IC chip 300 is less than 1 square centimeter, such as 49 square millimeters, 25 square millimeters, or 9 square millimeters, to meet the demand for miniaturization of the earphone 50.

In one embodiment, the IC chip 300 is a packaged IC chip having a plurality of connectors, such as pins or pads. The IC chip 300 can be attached on the substrate 102 via the plurality of connectors or fixed on the substrate 102 by adhesive. The IC chip 300 is electrically connected to the first electrode 104 and the second electrode 106 via conductive wires (not shown) getting through holes on the substrate 102. When the substrate 102 is conductive, the conductive wires should be coated with insulative layer. In work of the earphone 50, the IC chip 300 input an audio signal to the sound wave generator 108 and the sound wave generator 108 heats surrounding medium intermittently according to the input signal so that the surrounding medium to produce a sound by expansion and contraction.

Figure 10:
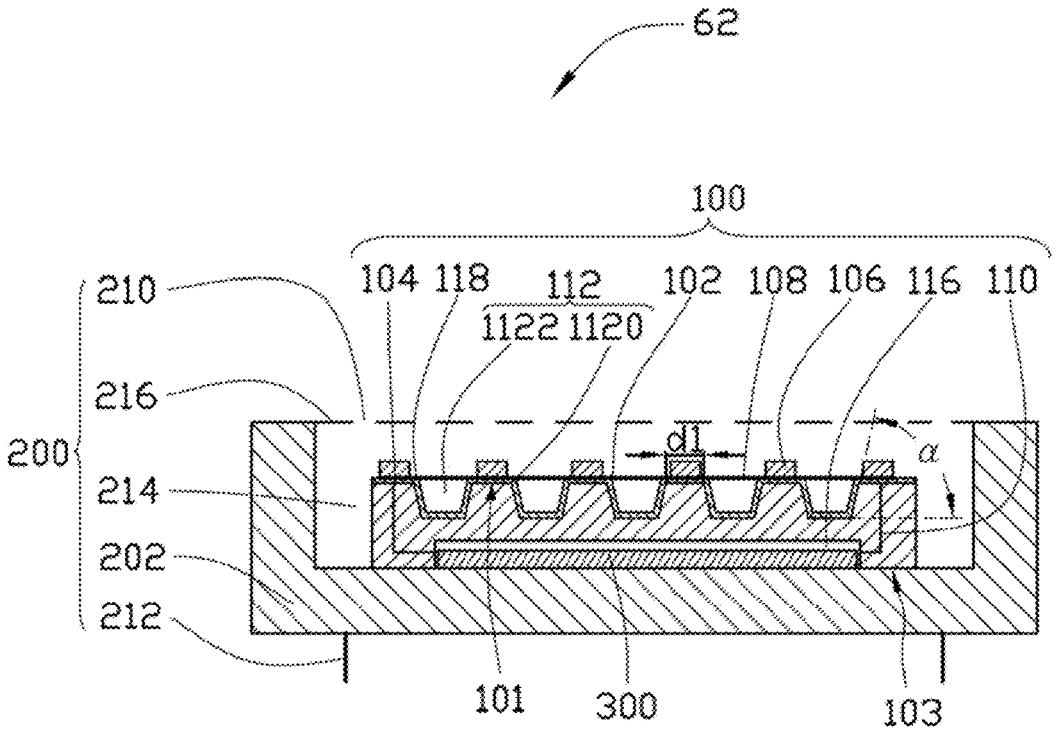
FIG. 10 is a schematic view of a thermoacoustic chip of an earphone in a sixth embodiment.
Figure 11:
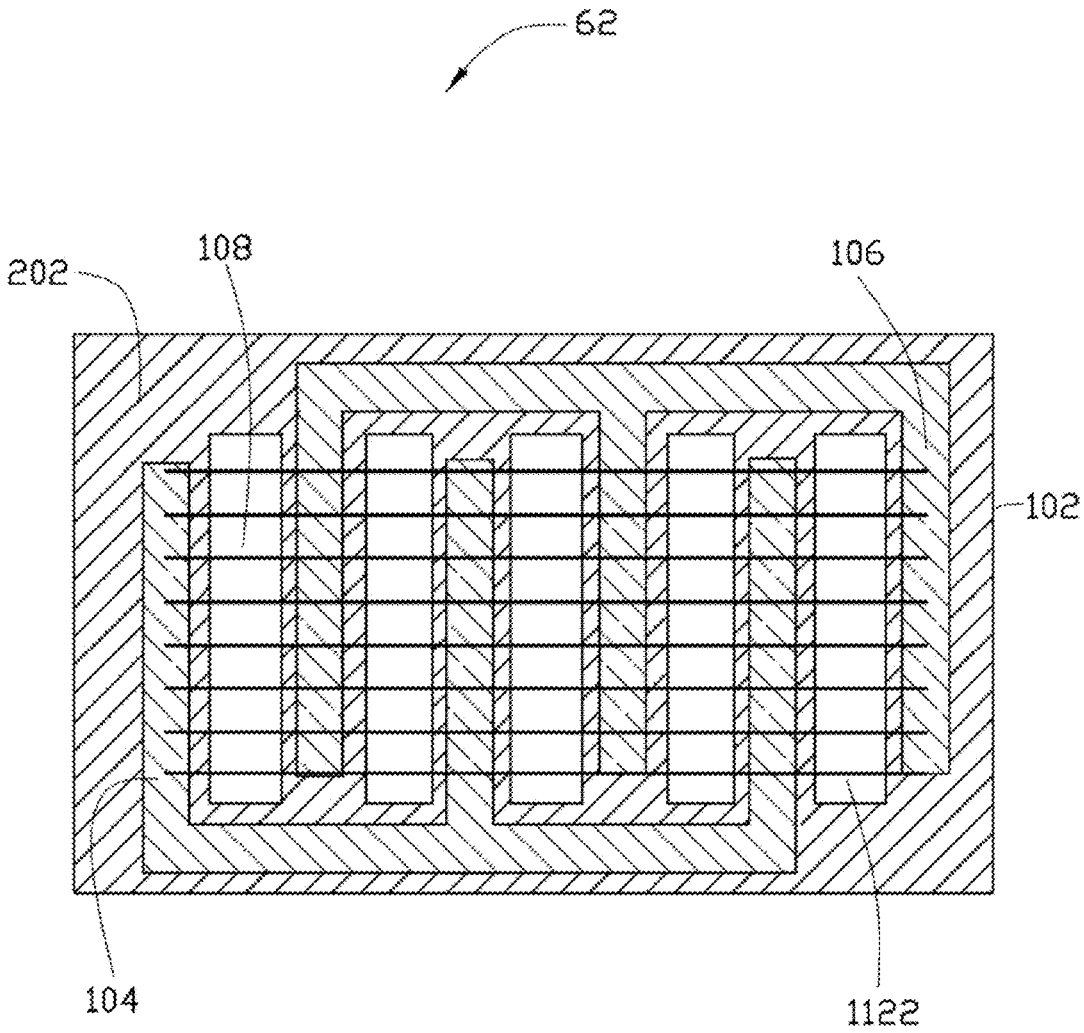
FIG. 11 is a top view of a speaker of the thermoacoustic chip of FIG. 10.

Referring to FIGS. 10-11, a thermoacoustic chip 62 of a sixth embodiment is shown. The structure of the thermoacoustic chip 62 is similar to that of the thermoacoustic chip 52, except that the substrate 102 is a silicon wafer, the IC chip 300 is directly integrated onto the substrate 102, and the substrate 102 has a concave-convex structure 122 on the first surface 101, and the sound wave generator 108 is suspended over the concave-convex structure 112. Further the speaker 100 includes a plurality of first electrodes 104 and a plurality of second electrodes 106.

The material of the substrate 102 can be monocrystalline silicon or polycrystalline silicon. Thus, the IC chip 300 can be made on the substrate 102 by microelectronics process, such as epitaxial process, diffusion process, ion implantation technology, oxidation process, lithography, etching, or thin film deposition. Thus, the size of the speaker 100 can be smaller to meet the demand for miniaturization and integration of the electronic devices. The concave-convex structure 112 allows the heat produced by the IC chip 300 and the sound wave generator 108 to dissipate fast and in time. The substrate 102 is near the second surface 103. The concave-convex structure 112 can be formed by etching after the IC chip 300 is made on the substrate 102. Then, the carbon nanotubes structure is placed on the concave-convex structure 112. Then, the first electrodes 104 and the second electrodes 106 are formed on the carbon nanotubes structure. Because the process of placing the carbon nanotubes structure and forming the first electrodes 104 and the second electrodes 106 do not involve high temperature process, so the IC chip 300 would not be damaged.

Figure 12:
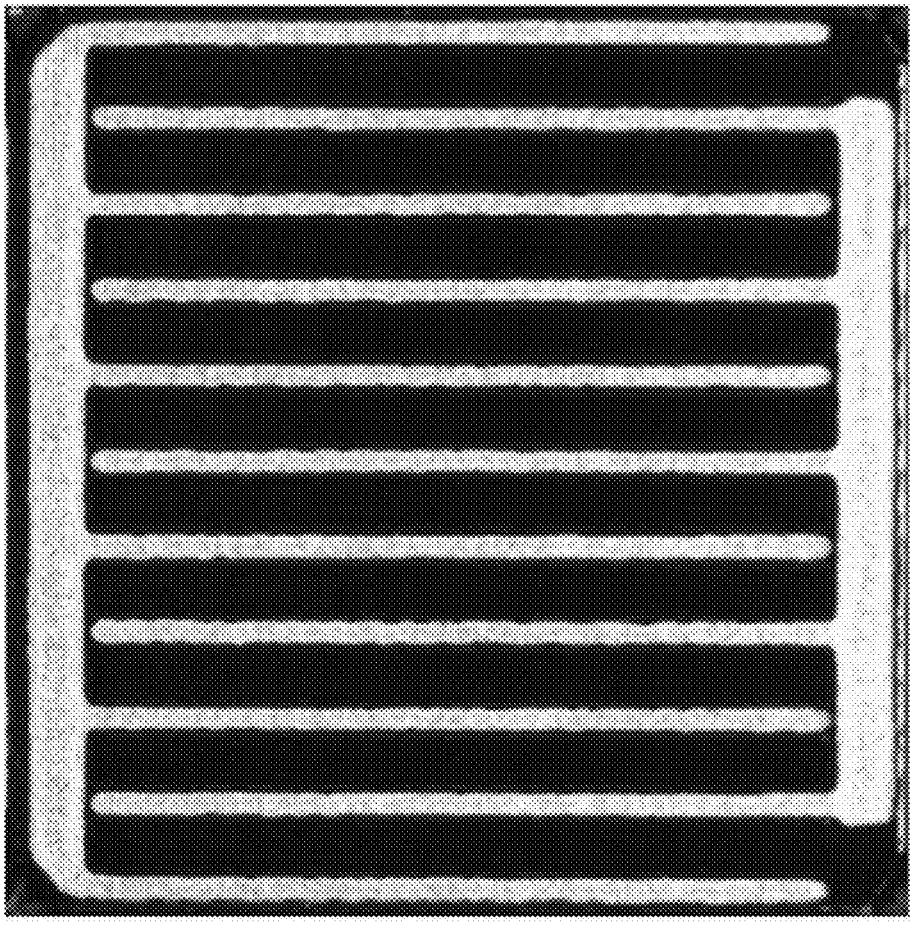
FIG. 12 is a photograph of the speaker of thermoacoustic chip of FIG. 11.

The concave-convex structure 112 defines a plurality of recesses 1122 and a plurality of bulges 1120 alternately located. The carbon nanotube structure has a first portion located on the top surface of the plurality of bulges 1120 and a second portion suspended above the plurality of recesses 1122. The plurality of first electrodes 104 and the plurality of second electrodes 106 are alternately located on the top surface of the plurality of bulges 1120. The plurality of first electrodes 104 and the plurality of second electrodes 106 can be located between the carbon nanotube structure and the plurality of bulges 1120, or the carbon nanotube structure can be located between the plurality of bulges 1120 and the plurality of electrodes 104, 106, that is, one part of the carbon nanotube structure is located on the top surface of the plurality of bulges 1120, other part of the s carbon nanotube structure is suspended over the plurality of recesses 1122. The plurality of first electrodes 104 are electrically connected with each other to form a comb-shaped first electrode, and the plurality of second electrodes 106 are electrically connected with each other to form a comb-shaped second electrode. As shown in FIG. 12, the tooth of the comb-shaped first electrode and the tooth of the comb-shaped second electrode are alternately located. Thus, the plurality of first electrodes 104, the plurality of second electrodes 106, and the sound wave generator 108 can form a plurality of thermoacoustic units electrically connected with each other in parallel, and the driving voltage of the sound wave generator 108 can be decreased.

The plurality of recesses 1122 can parallel with each other and extend along the same direction. The length of the plurality of recesses 1122 can be smaller than or equal to the side length of the substrate 102. The depth of the plurality of recesses 1122 can be in a range from about 100 micrometers to about 200 micrometers. The depth range can allow the sound wave generator 108 have a certain distance away from the bottom surface of the recess 1122 to prevent the heat produced by the sound wave generator 108 being absorbed by the substrate 102 too fast and too much, and simultaneously allow the sound wave generator 108 produce a good sound in different frequencies. The cross section of each of the plurality of recesses 1122 along the extending direction can be V-shaped, rectangular, or trapezoid. The width (maximum span of the cross section) of the each of the plurality of recesses 1122 can be in a range from about 0.2 millimeters to about 1 millimeter. The distance $d_1$ between adjacent two recesses 1122 can range from about 20 micrometers to about 200 micrometers. Thus the first electrodes 104 and the second electrodes 106 can be printed on the plurality of bulges 1120 by screen printing. Thus sound wave generator 108 can be prevented from being broken. Furthermore, a driven voltage of the sound wave generator 108 can be reduced to lower than 12V. In one embodiment, the driven voltage of the sound wave generator 108 is lower than or equal to 5V.

In one embodiment, the substrate 102 is square monocrystalline silicon wafer with a side length of 8 millimeters and a thickness of 0.6 millimeters. The shape of the recess 1122 is trapezoid. The angle $\alpha$ is defined between the sidewall and the bottom surface of the recess 1122. The angle $\alpha$ is equal to the crystal plane angle of the substrate 102. The width of the recess 1122 is about 0.6 millimeters, the depth of the recess 1122 is about 150 micrometers, the distance $d_1$ between adjacent two recesses 1122 is about 100 micrometers and the angle $\alpha$ is about 54.7 degrees.

Furthermore, an insulating layer 118 can be located on the first surface 101 of the substrate 102. The insulating layer 118 can be a single-layer structure or a multi-layer structure. In one embodiment, the insulating layer 118 can be merely located on the top surfaces of the plurality of bulges 1120. In another embodiment, the insulating layer 118 is a continuous structure, and attached on the entire first surface 101. That is, the insulating layer 118 is located on the top surfaces of the plurality of bulges 1120, and the side wall and bottom surface of the plurality of recesses 1122. The insulating layer 118 covers the plurality of recesses 1122 and the plurality of bulges 1120. The sound wave generator 108 is insulated from the substrate 102 by the insulating layer 118. In one embodiment, the insulating layer 118 is a single-layer structure and covers the entire first surface 101. The material of the insulating layer 118 can be $SiO_2$, $Si_3N_4$, or combination of them. The material of the insulating layer 118 can also be other insulating materials. The thickness of the insulating layer 118 can range from about 10 nanometers to about 2 micrometers, such as 50 nanometers, 90 nanometers, and 1 micrometer. In one embodiment, the thickness of the insulating layer is a single $SiO_2$ layer with a thickness of about 1.2 micrometers.

In one embodiment, the sound wave generator 108 includes a plurality of carbon nanotube wires in parallel with and spaced from each other. The extending direction of the plurality of carbon nanotube wires and the extending direction of the plurality of recesses 1122 are perpendicular with each other. Each of the plurality of carbon nanotube wire includes a plurality of carbon nanotubes substantially oriented along a direction along the length of the carbon nanotube wire. Part of the plurality of carbon nanotube wires are suspended over the plurality of recesses 1122. That is, the suspended parts of the plurality of carbon nanotube wires are free of contact with any other surface. The distance between adjacent two of the plurality of carbon nanotube wires can be in a range from about 1 micrometer to about 200 micrometers. In one embodiment, the distance between adjacent two of the plurality of carbon nanotube wires is in a range from about 50 micrometers to about 150 micrometers. In one embodiment, the distance between adjacent two of the plurality of carbon nanotube wires is about 120 micrometers, and the diameter of the plurality of carbon nanotube wires is about 1 micrometer.

In one embodiment, the plurality of carbon nanotube wires can be made by following steps:

step (10), laying a carbon nanotube film on the first electrode 104 and the second electrode 106, wherein the carbon nanotubes of the carbon nanotube film are substantially extend along a direction perpendicular with the extending direction of the first electrode 104 and the second electrode 106;

step (12), forming a plurality of carbon nanotube belts in parallel with and spaced from each other by cutting the carbon nanotube film along the extending direction of the carbon nanotubes of the carbon nanotube film by a laser; and step (13), shrinking the plurality of carbon nanotube belts by treating with organic solvent, wherein the organic solvent can be dipped on the plurality of carbon nanotube belts.

In step (12), the width of the carbon nanotube belt is in a range from about 20 micrometers to about 50 micrometers so that the carbon nanotube belt can be shrunk into carbon nanotube wire completely. If the width of the carbon nanotube belt is too great, after the shrinking process, the carbon nanotube wire will have rips therebetween which will affect the sound produced by the carbon nanotube wire. If the width of the carbon nanotube belt is too small, the strength of the carbon nanotube wire will be too small which will affect the life span of the carbon nanotube wire.

Figure 13:
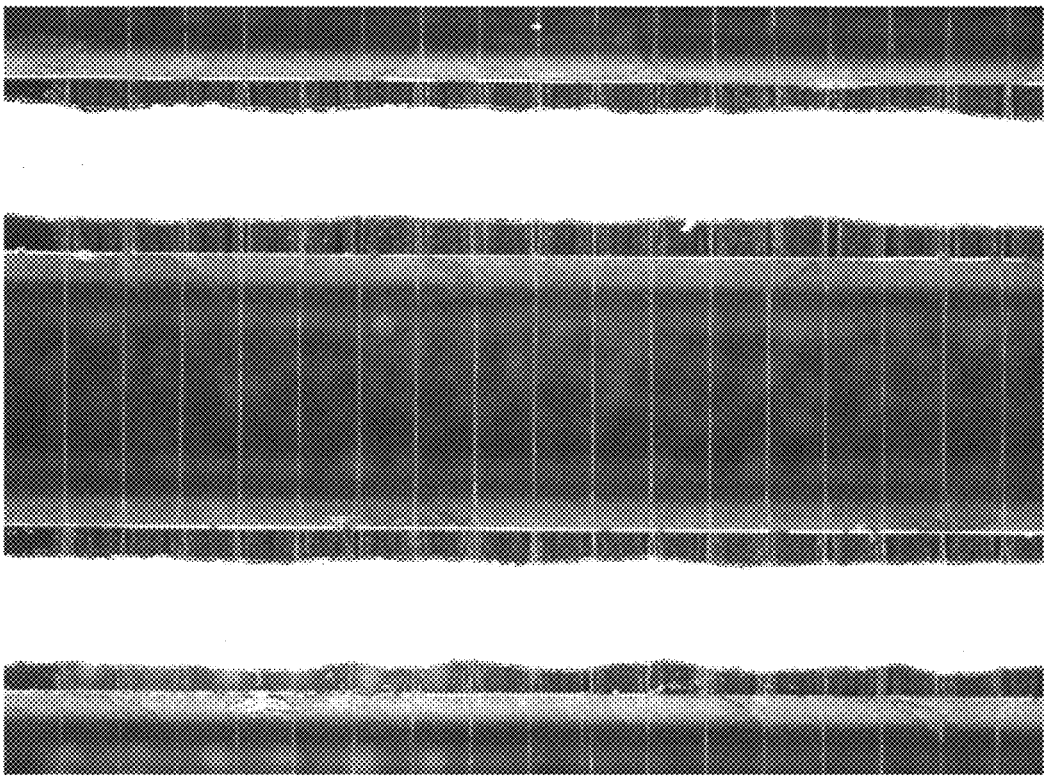
FIG. 13 is an optical microscope image of a plurality of carbon nanotube wires of the speaker of FIG. 12.

In step (13), the plurality of carbon nanotube belts is shrunk to form the plurality of carbon nanotube wires (the dark portion is the substrate 102, and the white portions are the first electrode 104 and the second electrode 106) as shown in FIG. 13. The two opposite ends of the plurality of carbon nanotube wires are electrically connected to the first electrode 104 and the second electrode 106. The diameter of the carbon nanotube wires ranges from about 0.5 micrometers to about 3 micrometers. In one embodiment, the width of the carbon nanotube belt is about 30 micrometers, the diameter of the carbon nanotube wire is about 1 micrometer, and the distance between adjacent two carbon nanotube wires is about 120 micrometers.

After treating the carbon nanotube belts, the driven voltage between the first electrode 104 and the second electrode 106 can be reduced. During shrinking process, a part of the plurality of carbon nanotube belts attached on the plurality of bulges 1120 will not be shrunk by the organic solvent so that the plurality of carbon nanotube wires have a greater contact surface with the first electrode 104 and the second electrode 106. Thus after being shrunk, this part of the plurality of carbon nanotube wires can be firmly fixed on the bulges 1120, and electrically connected to the first electrode 104 and the second electrode 106. Furthermore, after the shrinking process, the suspended part of the carbon nanotube wires are tighten and can prevent the sound produced by the carbon nanotube wire from being distorted.

Figure 14:
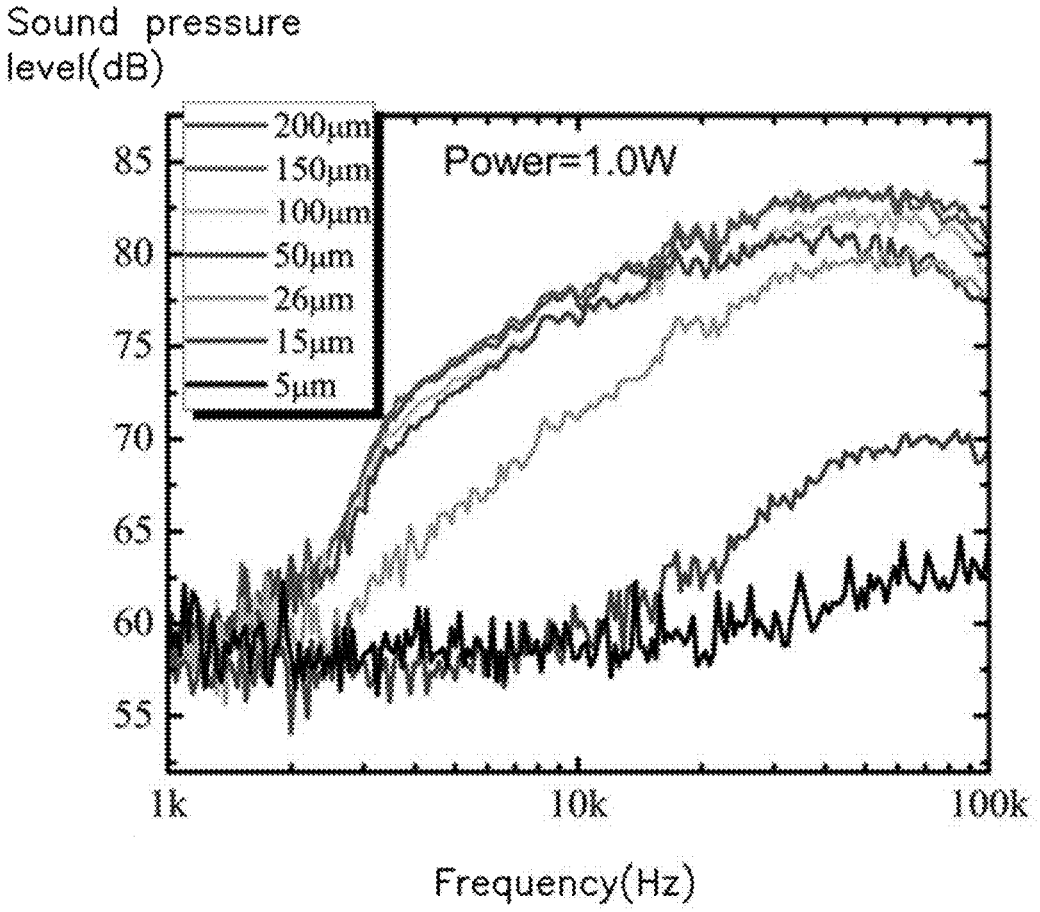
FIG. 14 shows a sound pressure level-frequency curve of the speaker of FIG. 11.
Figure 15:
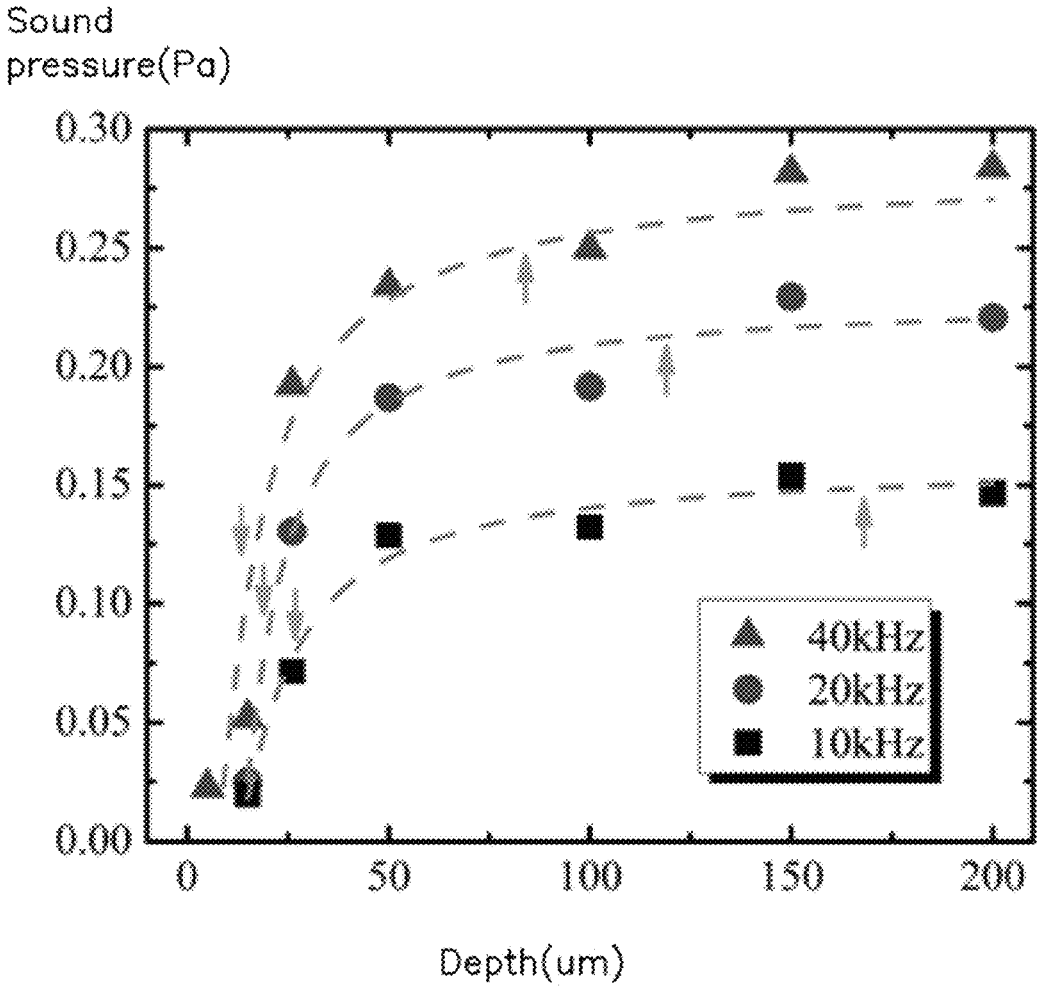
FIG. 15 shows a schematic view of acoustic effect of the earphone of FIG. 10.

Referring to FIGS. 14-15, the sound effect of the speaker 100 of the earphone 60 is related to the depth of the plurality of recesses 1122. In one embodiment, the depth of the plurality of recesses 1122 ranges from about 100 micrometers to about 200 micrometers. Thus, in the frequency band for which the human can hear, the earphone 60 have excellent thermal wavelength. Therefore, the earphone still has good sound effects even for its small size.

In use, the speaker can be located inside of the capsule to obtain an integrity thermoacoustic chip. When the thermoacoustic chip of the earphone fails to work, the thermoacoustic chip can be replaced easily, so that the lifespan of the earphone prolongs.

It is to be understood that the above-described embodiments are intended to illustrate rather than limit the invention. Variations may be made to the embodiments without departing from the spirit of the invention as claimed. Any elements discussed with any embodiment are envisioned to be able to be used with the other embodiments. The above-described embodiments illustrate the scope of the invention but do not restrict the scope of the invention.

What is claimed is:

1. An earphone, the earphone comprising:

a shell defining a first space;

a thermoacoustic chip disposed in the first space of the shell, wherein the thermoacoustic chip comprises a speaker, the speaker comprises:

a substrate having a first surface and a second surface opposite to the first surface;

a sound wave generator located on the first surface and insulated with the substrate;

a first electrode and a second electrode spaced from each other and electrically connected to the sound wave generator;

wherein the thermoacoustic chip further comprises a capsule defining a second space to accommodate the speaker, the capsule has at least one through hole and at least two connectors, the sound wave generator is opposite to the at least one through hole, two of the at least two connectors are electrically connected to the first electrode and the second electrode; the substrate is made of silicon, and a concave-convex structure is defined on the first surface of the substrate; and the concave-convex structure comprises a plurality of recesses and a plurality of bulges alternately located, a first part of the sound wave generator is located on a top surface of the plurality of bulges, a second part of the sound wave generator is suspended over the plurality of recesses, and a depth of each of the plurality of recesses ranges from about 100 micrometers to about 200 micrometers.

2. The earphone of claim 1, wherein the shell defines a plurality of through openings, and the thermoacoustic chip is spaced from and opposite to the plurality of through openings.

3. The earphone of claim 1, wherein the thermoacoustic chip is installed in the shell by a fastener.

4. The earphone of claim 1, further comprising a plurality of leading wires electrically connected to the at least two connectors of the thermoacoustic chip.

5. The earphone of claim 1, wherein the capsule comprises a plate and a housing, and the speaker is located on a surface of the plate and in the housing.

6. The earphone of claim 5, wherein the housing comprises a side wall and a bottom wall, connected to the side wall; and the bottom wall defines a plurality of through holes.

7. The earphone of claim 1, wherein the capsule comprises a plate defining a first recess and a cover covering the first recess, the speaker is located in the first recess, and the cover defines a plurality of through holes.

8. The earphone of claim 1, wherein the speaker further comprising an insulating layer continuously attaching on the entire first surface.

9. The earphone of claim 1, wherein the sound wave generator comprises a free-standing carbon nanotube structure, and part of the carbon nanotube structure is suspended.

10. The earphone of claim 9, wherein the carbon nanotube structure comprises a plurality of carbon nanotubes substantially oriented along a direction.

11. The earphone of claim 9, wherein the carbon nanotube structure comprises a carbon nanotube film, and the carbon nanotube film comprises a plurality of carbon nanotubes substantially extending along the same direction.

12. The earphone of claim 9, wherein the carbon nanotube structure comprises a plurality of carbon nanotube wires extending along the same direction, and the plurality of carbon nanotube wires is parallel with and spaced from each other.

13. The earphone of claim 1, wherein the speaker further comprises a plurality of third electrodes and a plurality of fourth electrodes, and the plurality of third electrodes and the plurality of fourth electrodes are alternatively located on the plurality of bulges.

14. The earphone of claim 1, wherein a width of each of the plurality of recesses ranges from about 0.2 millimeters to about 1 millimeter.

15. The earphone of claim 1, wherein the plurality of recesses are parallel with and spaced from each other, and a distance between adjacent two of the plurality of recesses range from about 20 micrometers to about 200 micrometers.

16. The earphone of claim 15, wherein the plurality of recesses extends along a first direction, the first electrode and the second electrode extends along a second direction that is parallel to the first direction, and the sound wave generator comprises a plurality of carbon nanotubes substantially extending along a third direction that is perpendicular with the first direction.

17. The earphone of claim 1, wherein the thermoacoustic chip further comprises an integrated circuit chip received in the capsule, and the capsule comprises four connectors electrically connected with the integrated circuit chip to supply driving voltage and to input audio signal.

18. The earphone of claim 17, wherein the integrated circuit chip comprises a power amplification circuit for amplifying audio signal and a direct current bias circuit, the substrate defines a cavity on the second surface, and the integrated circuit chip is located in the cavity.

* * * * *